US005651281A

United States Patent [19]

Seidel

[11] Patent Number: 5,651,281

[45] Date of Patent: Jul. 29, 1997

[54] METHOD AND APPARATUS FOR ROLLING ROLLED STRIPS

[75] Inventor: Jürgen Seidel, Kreuztal, Germany

[73] Assignee: SMS Schloemann-Siemaq, Düsseldorf, Germany

[21] Appl. No.: 634,075

[22] Filed: Apr. 17, 1996

Related U.S. Application Data

[63] Continuation of Ser. No. 220,325, Mar. 30, 1994, abandoned.

[30] Foreign Application Priority Data

Mar. 29, 1993 [DE] Germany ..... 43 09 986.6

[51] Int. Cl.[6] ..... B21B 37/00

[52] U.S. Cl. ..... 72/11.8; 72/9.2; 72/201; 72/226; 72/366.2

[58] Field of Search ..... 72/7.6, 8.9, 9.1, 72/9.2, 9.3, 11.6, 11.8, 12.3, 12.7, 12.8, 225, 229, 234, 226, 365.2, 366.2, 200, 201, 202

[56] References Cited

U.S. PATENT DOCUMENTS

| | | | |
|---|---|---|---|
| 3,882,709 | 5/1975 | Kawamoto et al. | 72/234 |
| 4,245,490 | 1/1981 | Kukobo et al. | 72/234 |
| 4,422,318 | 12/1983 | Christ et al. | 72/236 |
| 4,510,784 | 4/1985 | Hsu | 72/201 |
| 4,570,472 | 2/1986 | Kuwaro | 72/10.1 |
| 4,627,259 | 12/1986 | Andersson et al. | 72/202 |
| 4,658,620 | 4/1987 | Masui et al. | 72/234 |
| 4,711,109 | 12/1987 | Rohde et al. | 72/17 |
| 4,730,475 | 3/1988 | Ginzburg | 72/229 |
| 4,782,683 | 11/1988 | Tippins et al. | 72/201 |
| 4,860,564 | 8/1989 | Kaplan | 72/245 |
| 4,887,329 | 12/1989 | Perneczky | 72/236 |
| 5,085,065 | 2/1992 | Onderka et al. | 72/225 |
| 5,365,761 | 11/1994 | Knauschner et al. | 72/11.6 |

*Primary Examiner*—Lowell A. Larson
*Assistant Examiner*—Ed Tolan
*Attorney, Agent, or Firm*—Anderson Kill & Olick, P.C.

[57] ABSTRACT

A method for rolling rolled strips 3, 4 in a hot strip rolling mill 6, comprises at least two roll stands 6, 7, with horizontally adjustable top and bottom work rolls 10, 11. Each work roll is backed up directly or through an intermediate roll by a backup roll 9 or in a reversing stand where at least two passes are rolled, wherein the roll strip is subjected to a condition control for which profile the surface evenness-imparting correctively control elements act upon the rolled strip to meet requirements of profile accuracy and surface evenness of the rolled strips in spite of flexible rolling program if a target contour of the profile of the rolled strip 3, 4 is preset for achievement of which two groups of correction control elements act successively upon the rolled strip. The control elements 12, 13 of first group are brought to bear if a rolled strip thickness is above the critical thickness and influence largely the contour of the rolled strip in its central region referred to the strip center. The control elements 12, 13 of the second group are brought to bear in the strip edge region if rolled strip thicknesses below the critical thickness.

5 Claims, 5 Drawing Sheets

FIG. 7
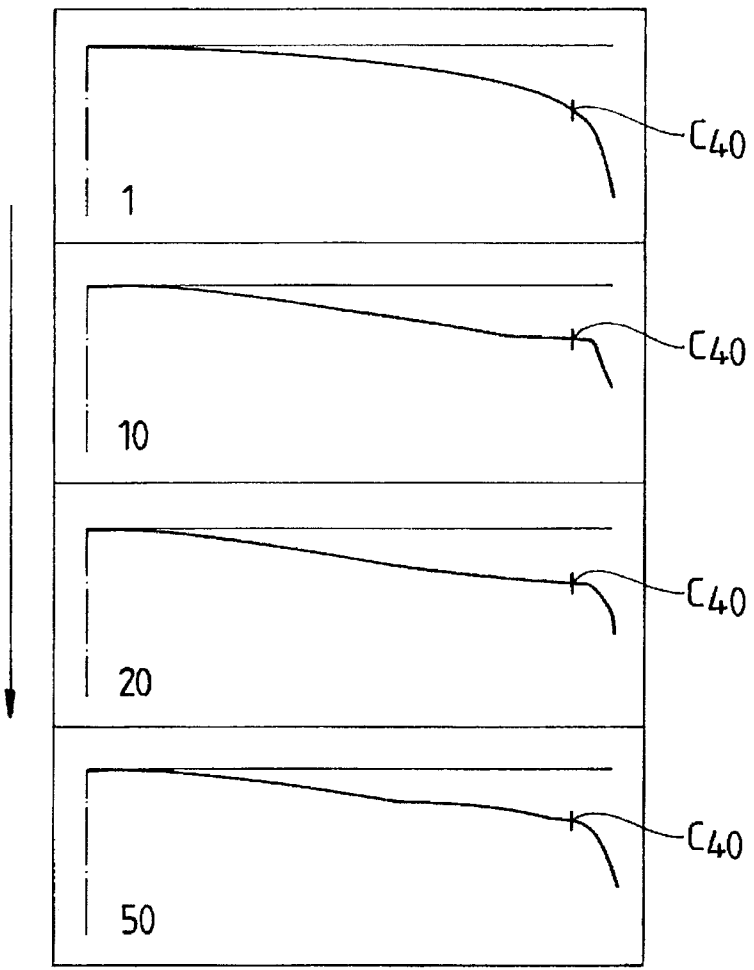
FIG. 6 *PRIOR ART*
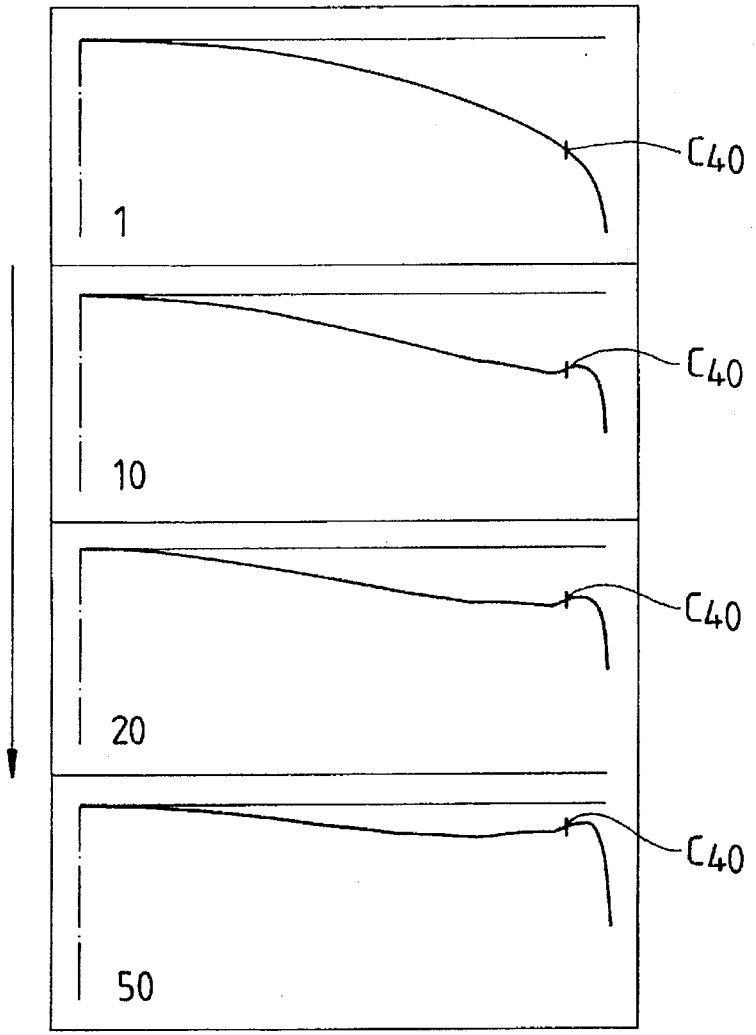

METHOD AND APPARATUS FOR ROLLING ROLLED STRIPS

This is a continuation application of Ser. No. 08/220,325, filed Mar. 30, 1994 now abandoned.

FIELD OF THE INVENTION

The present invention deals with a method and an apparatus for rolling rolled strips in a hot strip mill.

BACKGROUND OF THE INVENTION

In hot rolling of strip material, the thermal camber and wear of the work rolls, as well as elastic deformations within a rolling program are subject to relatively large changes. Without correction by final control elements, the cambering of the work rolls increases continuously with increasing rolled material throughput. Because of changing thermal camber, the roll contour increasingly deviates from the nominal contour, for instance, a parabola.

When rolling one single width, a plurality of strips is rolled consecutively at the same (or approximately the same) width within a single rolling program. Rolling at a single width affects not only the magnitude of the strip profile predetermined for a very specific point (for instance $C_{40}$ or $C_{25}$), but also the strip profile shape overall. The definition of the strip profile herein, for a very specific point, is the difference between the thickness of the strip at its center and the average value of the thickness measured on each side as to be spaced from the strip edge at the point $C_{40}$, corresponding to a spacing of 40 mm.

The increasing fall-off of the thermal cambering of the rolls leads to considerable profile anomalies in the strip in the region near the edge. This is meant to include all deviations of the strip from the ideal (for instance parabolic) course of the strip profile. Both thickening in the edge region (beads, edge build-up) and reduction of the thickness in the edge region are types of profile anomalies to be avoided in actual rolling practice. Such profile anomalies greatly restrict the rollable length in one specific width. The roll lengths in one single width is defined as the sum of all strip lengths which are rolled at one single width or approximately at the same single width.

Compensating for the change of the thermal crowns and the work roll wear by suitable control members such as displacement and/or bending members, for instance, "CVC" (Continuously Variable Crown) displacement (see, e.g., DE 30 38 865 C1) or by a suitable cooling means.

EP 0 276 743 B1 teaches adjusting the horizontal displacement of the work rolls and the bending forces acting upon these work rolls in a group of rolling stands located on the upstream side of a tandem rolling mill, in proportion to the rolling conditions, including the width of the strip, for controlling the cambering and/or the edge reduction of the strip. For controlling the wear and the thermal cambering of the work roll to avoid undesirable profile shapes when rolling at a single width, the work rolls in a group of rolling stands, located at the downstream side, are moved to and from at predetermined intervals, irrespective of the width of the strip. The rearward stands herein are displaced by a specific amount in the opposite direction after every strip. If the amount of displacement has attained a maximum value, the displacement direction is reversed. The wear of the work rolls is made more uniform across a larger region because of this cyclic displacement.

EP 0 219 844 B1 discloses determining the profile of every work roll in axial direction, which changes during the time interval between a change of the work rolls. Thereupon, the configuration of the gap between the top and bottom work roll, on the basis of the determined roll profile, is fixed in axial direction as a function of the magnitude of a relative displacement of the roll positions, in order to determine that magnitude of the displacement of the roll positions which establishes, as flat as possible, a configuration in axial direction for the gap within the contact region between the rolled strip and the work rolls. Thus, in this case, the smoothing of the rolling gap is desired.

The known measures are, however, inadequate to fulfill increased requirements as far as the profile accuracy and the surface evenness under extreme marginal conditions is concerned. These today consist of the fabrication of hot strips being able to establish the rolling programs in a flexible manner. Apart from larger thicknesses and material changes, width changes in direction narrow and wide are desired (mixed rolling). In addition, the quantity of the strips of the same width within one rolling program is to be increased.

It is therefore an object of the invention to provide a method and an apparatus by means of which the requirements of profile accuracy and surface evenness of the rolled strip can be fulfilled, in spite of flexible rolling programs.

Another object of the invention is to provide a method and an apparatus in which profile anomalies such as the thickening and the reduction of thickness in the edge regions of the strips are avoided.

SUMMARY OF THE INVENTION

These and other aspects of the invention, which shall become apparent hereafter, are achieved by a Method and Apparatus for Rolling Rolled Strips, comprising at least two rolling stands with horizontally adjustable top and bottom work rolls with each work roll being backed up directly or through an intermediate roll, by a backup roll, or a reversing stand where at least two passes are rolled. The rolled strip is subjected to a control for which purpose profile and surface evenness or smoothness imparting final control correction elements act upon the strip.

One proceeds no longer from a nominal profile for a quite specific point, rather from a predetermined strip profile adapted to a very specific purpose of the rolled strip. For a hot strip which has to be directly processed further, one strives for a more parabolic contour and for the entry profile into a cold rolling train, a profile adapted to correspond to the conditions existing there (diameter, rolling force, etc.) with flat body crown and a somewhat more pronounced drop at the strip edges is desired. The invention is based on the knowledge, discovered by extensive research, that with thick material, lateral or cross flow occurs in the central rolled strip region, whereas with thin strip material, lateral flow is possible only in the edge region. If the strip profile shape in the central rolled strip region is to be changed, this can be achieved only in a thick strip. Whereas strip shape change is achievable with thinner strips, there is a significant lack of surface smoothness. However, this can be achieved only in the closer proximity of the strip edge region. The relevant strip profile's susceptibility to be influenced migrates successively in the outward direction with diminishing strip thickness, meaning it migrates towards the strip edge.

This knowledge has now assumed a direct influence in the invention upon the expedient use of final correction elements, wherein the first group of the final correction elements affects mainly the central strip contour and the correction elements of the second group act upon the strip edge region. The final control elements can be utilized in such a way with the assistance of a computer model (computation method) that, with regard to the technical limits (for instance rolling force, temperature, etc.), the surface evenness limits (resulting from the respective material lateral flow of the strip and thus representing physical limits) possibly also of a higher order, the final control correction limits and especially with regard to the material flow behavior, an optimum strip shape is generated which approaches, as closely as possible, to the predetermined target contour.

It is particularly advantageous, if the predetermined target contour of the strip profile for a specific material grade is defined by a polynomial function:

$$Y=A_2X^2+A_4X^4+A_6X^6+A_nX^n$$

with the help of a computer model, depending upon the strip width coordinate and the strip thickness. Y represents the strip thickness coordinate and X the strip width coordinate. Symmetry is produced by leaving off the uneven members. Since $A_0=0$, the function passes through X=0, Y=0 (corresponding to the strip center). The use of members of a higher order makes it possible to define a steeper transition at the strip edge.

It is advisable that, with a strip profile shape deviating from the targeted contour, the mechanical final control elements are used in such a way that a minimum deviation between the computed strip shape and the nominal strip shape or target contour results. If the strip profile shape cannot be produced in stand i, the mechanical final control correction elements are to be adjusted in the sense of minimizing the deviation. Deviations of the computed strip shape, from the nominal strip shape, can be differently weighted across the width of the strip.

A refinement of the invention provides that the mechanical correcting elements be assisted by non-mechanical correcting elements, depending upon the contour of the strip in particularly the edge area. Work rolls utilized as mechanical correction elements can be locally heated or cooled in the targeted manner.

In one aspect of the invention, work rolls used as correction elements can be ground during the rolling process. This can be achieved, for instance, by oscillating grinding disks and permitting smoothing of the rolls or to polish change their contour to influence the strip contour in a targeted manner. Such an "on line" grinding process is particularly advisable in a program change to wider rolled strips, since grinding the work rolls ends even during the rolling process of the narrow rolled strip, does not effect the quality of these narrow strips since the work roll ends, which have been ground in a preparatory manner, lie outside of the rolling width.

It is proposed that mechanical correcting elements be put into use as early as possible. With due regard to the limits to be observed, for instance of the surface evenness and the correction region, it is attempted to achieve the aimed for contour of the profile of the rolled strip, as early as possible. If this is not possible in the first stand, then the task is automatically passed on to the following stands. If the strip shape cannot be held constant from one rolling stand to the other, or from one pass to the other, then, according to the laws of the material lateral flow, a deviation in the edge region of thicker strip can be tolerated, meaning the achievement of the strip shape or aimed-for contour in the central rolled strip region has priority. If the strip profile shape is produced in one single rolling stand, for instance stand k, then it is the foremost aim to keep this strip shape constant in the following stands.

It is proposed, for performing this method, that the correction elements comprise axially displaceable work rolls and/or work roll bending arrangements. In order to produce the desired preset strip shape in the central rolled strip region by mechanical correction elements, preferably the continuous variable crown, work roll bending, roll stagger, etc. can be performed. If, for instance, wide strips are rolled, the non-parabolic effect of the work roll bending, meaning the greater effect in the strip edge region (200 mm) must be taken into account and preferably a combination of, for instance, continuously variable crown and work roll bending, is to be used which approaches closest to the nominal or aimed for strip contour. For producing or keeping the strip shape constant in the strip edge region, it must be borne in mind, as far as the use of mechanical correction elements is concerned, that the work roll wear contour caused by different strip widths and traversing positions is to be located in such a way that the nominal strip contour is being approached as closely as possible. The same applies when utilizing known special continuous variable crown rolls, which permit achieving a tapered effect. Finally, it is advisable to cyclically displace the work rolls, preferably those in the rear stand of the hot rolling train, whereby as continuous as possible work roll wear contour, which is without any skimping, can be obtained.

The mechanical control or correction elements can be assisted by other control elements. Therefore in one aspect of the invention, the work rolls are provided with cooling means in certain zones and/or any insulation in order to assist the mechanical correction elements. To influence the shape of the thermal crowns of the work rolls and the roll strip shape, mainly in the area of the strip edges, it is possible to position, for instance, work roll covering shells at a suitable point at the end of the work rolls. An existing influence upon the rolled strip shape can furthermore be achieved by strip edge temperature changes to be performed within the range of the technological limits. For this purpose, changes of the edge heating can be achieved by induction heating before and/or behind the first stand of the finishing train. Cooling of the strip edges can be achieved, for instance, by spray nozzles attached in the side guides, which can be advantageous for austenitic high grade steels which have to be rolled.

Furthermore, the strip contour in the strip edge region can be influenced by lubricating the work rolls in the said region. In order to mainly affect the strip profile at the strip edge, the work rolls can be provided with a special grind. This can, for instance, be in the form of a parabolic contour change or by a local change in the strip edge region. When changing the strip profile shape, the surface evenness limits, also of a higher order, as well as the technological limits are, in all cases, to be observed.

Furthermore, it can be advisable to set up a changed rolling force, at least in the last or rearmost rolling stand if, in spite of the targeted use of the mechanical correction measures, deviations from the strip nominal contour could still be present. In these cases, the rollable shape can be affected in the edge region or a redistribution of the rolling force within the permissible limits can be performed by a change of the rolling force in the rear roll stand. The change of the body crowns accompanying the above process, at the corresponding and other roll stands, can be compensated by correction elements which do not act at the edge, for instance, by continuously variable crowns (CVC), in order not to interfere there with the mass flow and thus avoid undulations in the rolled strip. The algorithm is used in the on-line operation. It can however also be drawn upon, in combination with an optimizing algorithm for optimum rolling programs, and optimal utilization of control or correction elements in the leading front area. Thus, not only a single strip but also the entire rolling program is considered and is optimized as far as the strip contour is concerned.

BRIEF DESCRIPTION OF THE DRAWINGS

The invention will be better understood, by the Detailed Description of the Preferred Embodiment with reference to the drawings of which:

FIG. 6 is a graphic illustration showing the effect of the thermal crowns with increasing quantity of rolled strips in the known rolling processes;

FIG. 7 is a strip profile which can be achieved with the same quantity of strips as in FIG. 6, by the use of the measures in the invention.

DETAILED DESCRIPTION OF THE PREFERRED EMBODIMENT

Figure 1:
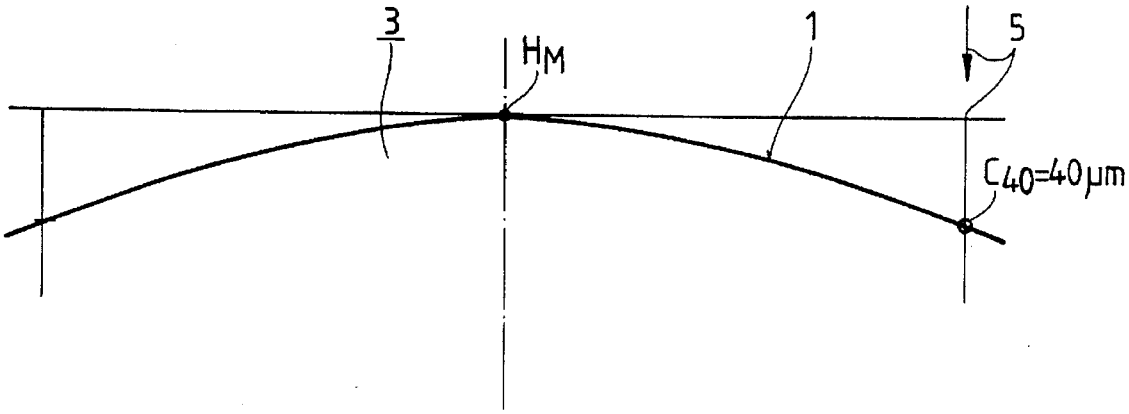
FIG. 1 depicts a first preset contour of the profile of a rolled strip.
Figure 2:
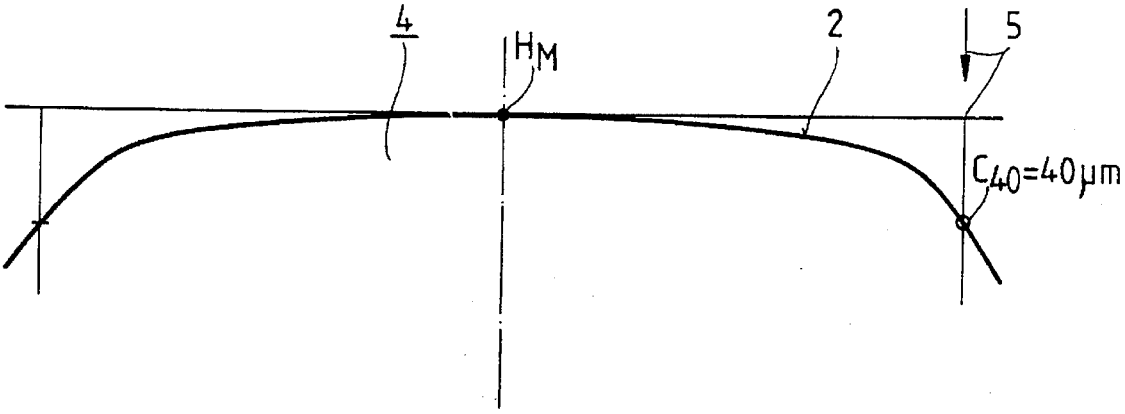
FIG. 2 depicts a second preset target contour of the profile of a rolled strip.

Referring now to the drawings, wherein like numerals reflect like elements, as a prerequisite for achieving of desired planar rolled strip and rolled strip with a precise profile, accurate profile target contours 1 or 2 shown in FIGS. 1 and 2, of a profile of rolled strip 3 or 4 are preset in accordance with the purpose of utilization. Corresponding to the requirements, the targeted contour 1, according to FIG. 1 is desired for a rolled strip 3 which is to be further processed for the inlet profile into a cold rolling mill, for instance, a targeted contour 2 corresponding to FIG. 2. FIG. 1 depicts a nearly parabolic targeted contour, while the targeted contour in FIG. 2 comprises a flat body crown and a somewhat more pronounced drop at the strip edges. The $C_{40}$ point registered in this case for both target contours 1, 2 results from the difference between the thickness of the rolled strip 3 or 4 in the center $H_M$ and the average value of the thicknesses at each side or strip edge 5 of the rolled strip 3 or 4, measured at a spacing of 40 mm from the edge 5.

Figure 3:
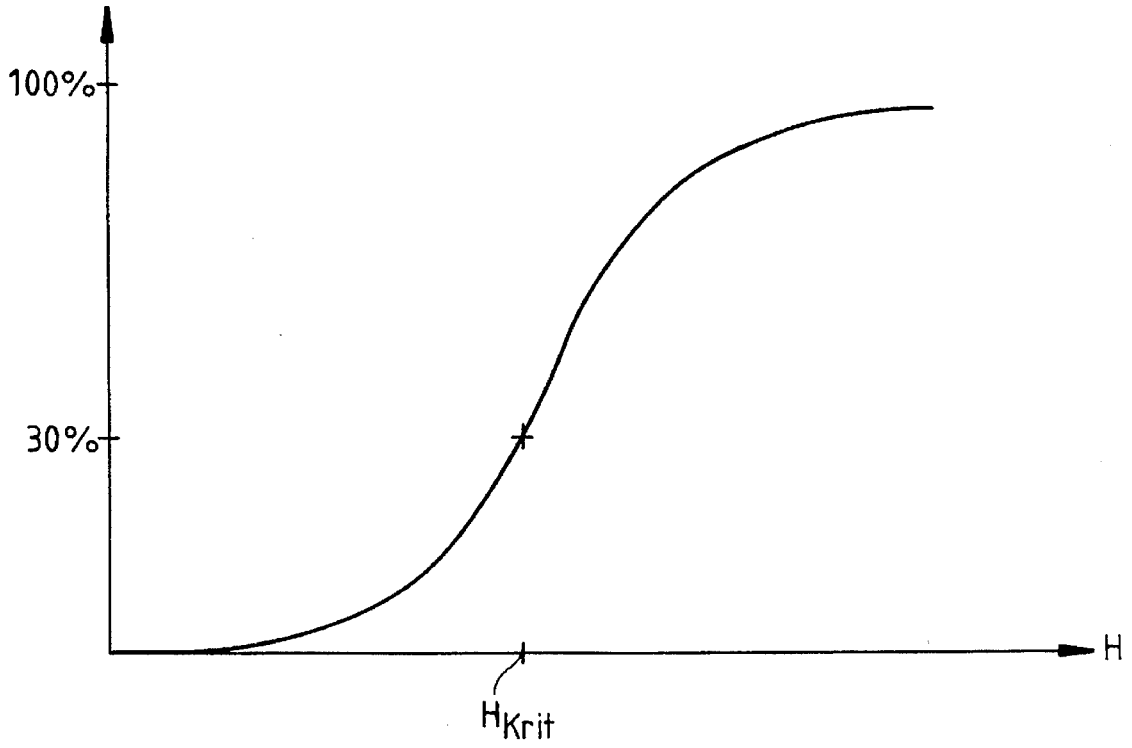
FIG. 3 is a diagram showing the material lateral flow as a function of the thickness of the rolled strip.
Figure 4:
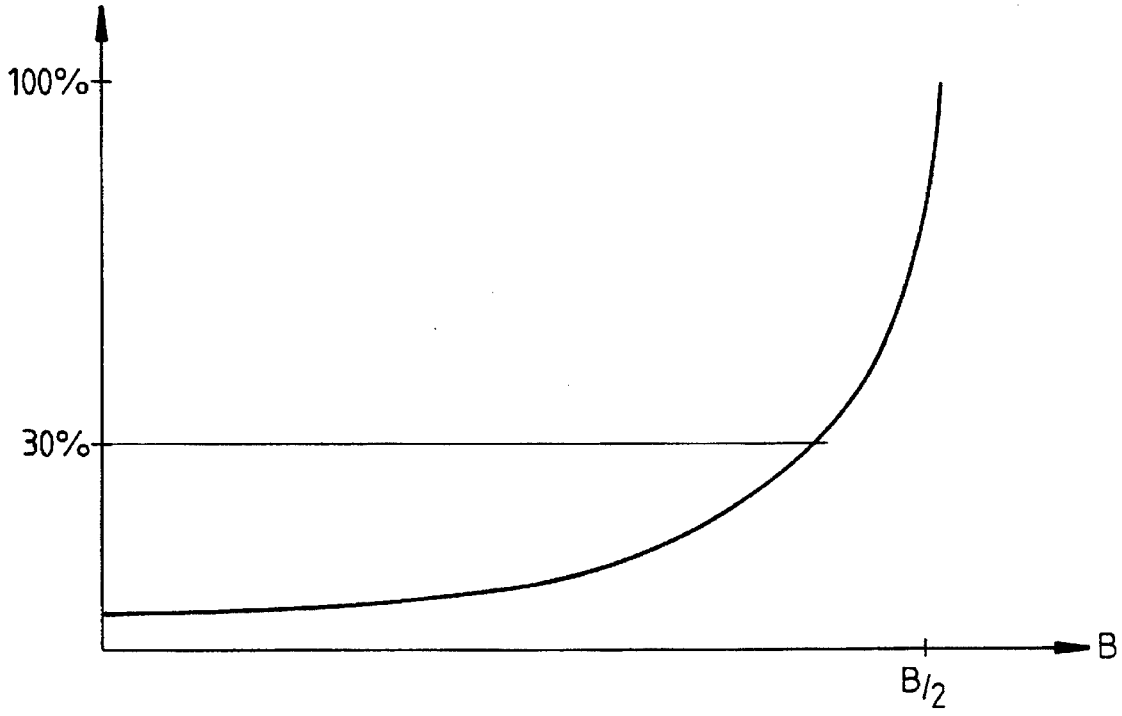
FIG. 4 is a diagram showing the material lateral flow across the width of the strip.
Figure 5:
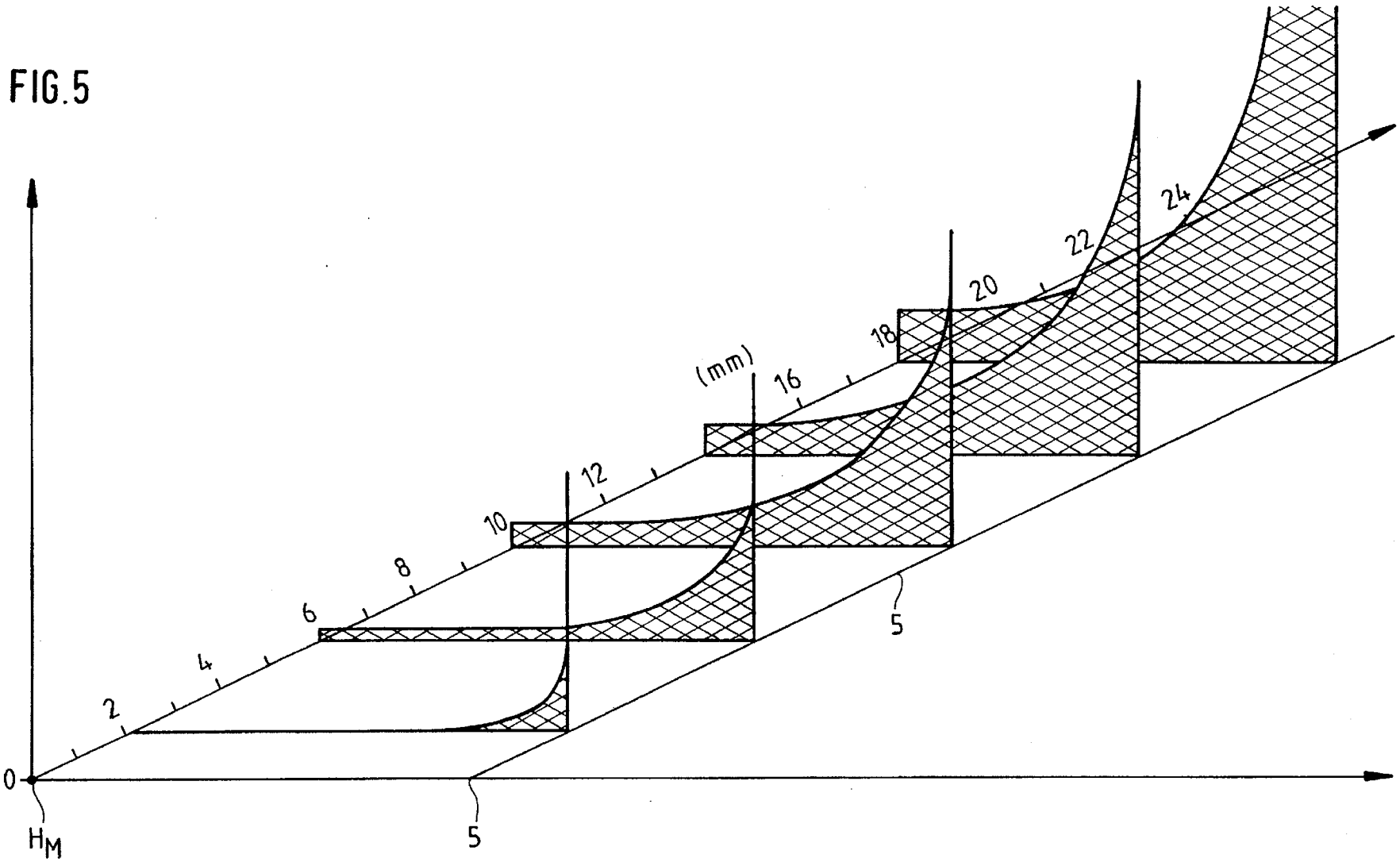
FIG. 5 is a diagram showing the material lateral flow as a function of the width coordinate and the material thickness for a material quality Q.

The attainment of target contours 1 or 2 is postulated on the knowledge resulting from FIGS. 3 to 5, namely influencing the strip contour can only be achieved where material cross or lateral flow is possible. As has been discovered through research for rolled strips with a strip thickness above the critical thickness $H_{crit}$ (see FIG. 3) material lateral cross flow occurs in the central region (see FIG. 5) adjoining the strip center. In rolled strip with lower thickness beneath $H_{crit}$, material lateral flow occurs only in the strip edge region. The limit value of the thickness, meaning the critical thickness $H_{crit}$, can be determined experimentally for every hot strip tandem mill as a function of the rolled material, temperature, roll diameter, as well as the reduction and distribution of passes, wherein it is generally known that affecting a profile of the rolled strip, while simultaneously avoiding surface evenness flaws, can be achieved only as long as the flow resistance of the material laterally to the rolling direction is still so small, that apart from the strip lengthening, a modicum of strip widening is set up in the rolling gap. As seen from FIG. 4, a material lateral flow below a critical thickness (for instance 10 or 12 mm) across the strip width is possible, only to a very slight extent. This interconnection is also clear from FIG. 5, wherein, apart from the coordinates for material cross-flow and the strip width, the material thickness has additionally been entered.

The strip profiles within a rolling program comprising 50 strips or coils, which can be achieved with a known rolling processes (see FIG. 6) and with the use of the inventive contour and surface evenness control (see FIG. 7), are shown in FIGS. 6 and 7. The characters on the left hand side indicate the quantity of the coils. While in both cases, the shape of the profile is nearly unchanged for the first strip or coil to be rolled, the effect of the thermal crown upon the work rolls with the disadvantageous anomalies for the quantity profile increases in the known rolling processes with increasing quantity of strips or coils. This means flat strip profiles and edge beads are formed (see FIG. 6, the strip profile after rolling 10, 20 or 50 strips). Whereas the strip profiles can be held largely constant according to FIG. 7 and edge beads are avoided and the aimed-for strip contour is almost achieved.

Figure 8:
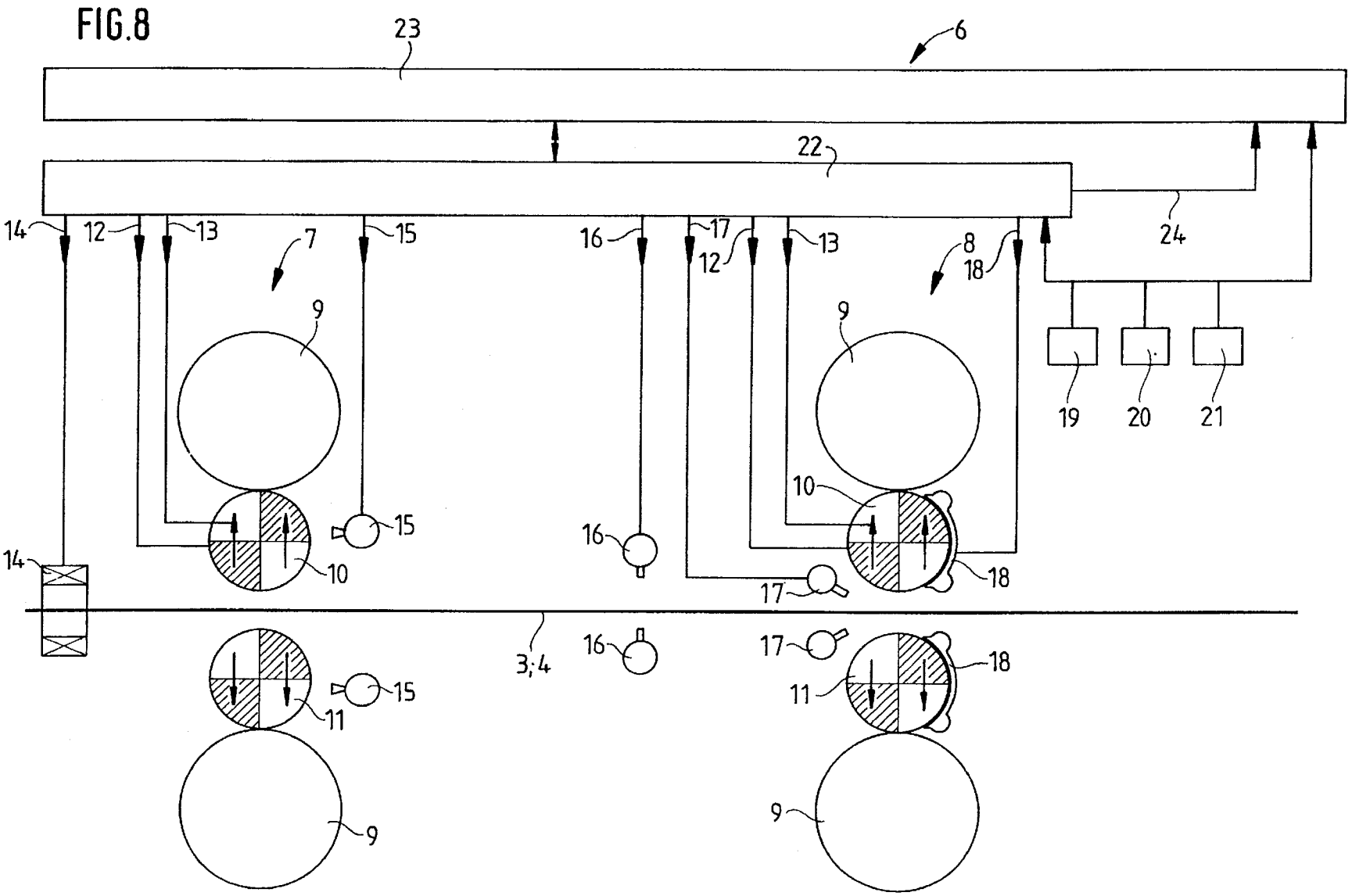
FIG. 8 depicts the inventive build-up of a contour and surface evenness control for hot rolled strip mills.

A hot strip rolling tandem mill 6, enabling the achievement of the desired strip profile (see FIG. 7) is illustrated in FIG. 8, partially schematically and with merely symbolic designations for the mechanical correction elements, including the elements assisting the same, as well as in the form of black boxes for computers and measuring instruments. It consists of several rolling stands, of which the first and the last rolling stands 7 or 8 are shown. It can however also be a rolling mill with a reversing stand, where several passes are rolled. Each one of the rolling stands 7, 8 has horizontally adjustable top and bottom work rolls 10, 11, backed up by back-up rolls 9. The work rolls 10, 11 can be axially displaced, preferably with CVC displacement 12 and can also be equipped with work roll bending arrangements 13. The axially to be displaced work rolls (equipped with ground, thermal and wear contour) or the CVC-displacement 12 and the work roll bending 13 are utilized as mechanical correction elements, acting in a targeted manner in the strip central region or in the strip edge region.

A strip edge heating arrangement 14 for changing the edge heating of the rolled strip 3 or 4 is disposed upstream or downstream of the first stands of the finishing train for assisting the mechanical correction elements 12, 13. In order to thermally affect the strip shape, namely by the changes caused by the thermal crowns of the work rolls 10, 11, the hot strip tandem mill 6 has a work roll zone cooling means 15, for instance in the form of spray nozzles oriented upon the work rolls 10, 11 in their respective zones in the region of the front and rear roll stands, as indicated behind the first rolling stand 7. Furthermore, a strip edge cooling means 16 with spray nozzles disposed, for instance, in side guides and work roll cover shells 18 assist the thermal influence, as it is shown for the last rolling stand 8. The lubrication of the work rolls 10, 11 in the strip edge region affects the load distribution in the rolling gap and thus the strip contour. Thickness, surface evenness and temperature measuring instruments 19, 20, 21 are disposed downstream of the last rolling stand 8.

The measuring instruments 19 to 21, as well as the mechanical control elements 12, 13 and the thermal and other elements 14 or 18 exerting an influence are connected to a strip contour and surface evenness computer 22. The measuring data acquired, especially for the profile and the surface evenness of the exiting finish-rolled strips 3, 4 can therefore be directly utilized for correcting the regulation systems or control elements located upstream, with the aim of achieving the preset target contour of the profile of the rolled strip or the entirety of the strips or coils. A pass planning computer 23, supplies the strip contour and surface evenness computer with input data. A data feedback 24 is intended for rolling force redistribution.

The described method of achieving a preset target contour of the rolled strip is used in an in-line operation. Nevertheless, in the course of rolling program preparation (planning of the rolling program), the processes can be simulated off-line and the strip shape can be determined in this way. If it is seen that the optimizing process performed in the leading field area with respect to the strip shape for specific strip is not successful, the rolling program can be redirected or the strip can be used in another rolling program. It is also possible to include a cyclical displacement of the rear work rolls or the rolling stands and/or an optimum positioning of, for instance, the covering shells 18 for thermal crown influence upon the work rolls 10, 11, so long as it is matched to the rolling program. After the strip sorting or rolling program, redirecting the process which optimizes the targeted contours starts anew, until an acceptable strip shape can be achieved off-line, even already in the leading field.

While the preferred embodiment of the invention has been depicted in detail, modifications and adaptations may be made thereto, without departing from the spirit and scope of the invention, as delineated in the following claims:

What is claimed is:

1. A method of rolling a rolled strip having a preset targeted profile contour in a hot strip line, which includes at least two rolling stands having horizontally adjustable top and bottom working rolls and back-up rolls for supporting the top and bottom working rolls, and a reversing stand, in which at least two passes are rolled, said method comprising the steps of:

providing mechanical correction means comprising two groups of correcting elements for acting on the rolled strip for obtaining the preset targeted profile contour; and actuating the first group of correcting elements for acting on a central region of the rolled strip when the rolled strip has a thickness exceeding a critical thickness and affects mainly the contour of the rolled strip in its middle range relative to the width of the strip, and actuating the second group of correcting elements for acting on an edge region of the rolled strip when the rolled strip has a thickness which is below a critical thickness.

2. The method of claim 1, wherein the preset targeted profile contour is defined by a polynomial function $$Y=A_2X^2+A_4X^4+A_6X^6+A_nX^n,$$

wherein Y represents a strip thickness coordinate and X represents a strip width coordinate.

3. The method of claim 1, wherein the mechanical correction means is actuated in such a way that a minimum deviation between a computed profile contour and the preset targeted profile contour is obtained.

4. The method of claim 1, wherein the mechanical correction means is actuated as early as possible.

5. The method of claim 1, further comprising the step of locally heating the working rolls.

* * * * *